US008814324B2

(12) United States Patent
Okazaki et al.

(10) Patent No.: US 8,814,324 B2
(45) Date of Patent: Aug. 26, 2014

(54) LIQUID JETTING APPARATUS

(75) Inventors: Naoya Okazaki, Gifu-ken (JP); Masayuki Tanaka, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 248 days.

(21) Appl. No.: 13/362,438

(22) Filed: Jan. 31, 2012

(65) Prior Publication Data

US 2012/0218349 A1 Aug. 30, 2012

(30) Foreign Application Priority Data

Feb. 28, 2011 (JP) ..... 2011-041621

(51) Int. Cl.
*B41J 3/00* (2006.01)
*B41J 2/175* (2006.01)

(52) U.S. Cl.
USPC ..... 347/37; 347/85

(58) Field of Classification Search
USPC ..... 347/37, 84, 85, 86
See application file for complete search history.

(56) References Cited

U.S. PATENT DOCUMENTS

2005/0195252 A1 * 9/2005 Ishikawa et al. ..... 347/84

FOREIGN PATENT DOCUMENTS

JP 2004-306394 11/2004
JP 2010-155417 7/2010

* cited by examiner

*Primary Examiner* — Jannelle M Lebron
(74) *Attorney, Agent, or Firm* — Frommer Lawrence & Haug LLP

(57) ABSTRACT

A liquid jetting apparatus includes: a head unit which includes a liquid jetting head which jets liquid and a liquid storage tank in which the liquid to be supplied to the liquid jetting head is stored; a guide member which extends in a first direction; a carriage which has a connection portion, carries the head unit, and is supported by the guide member to be movable in the first direction; and a movement mechanism which is connected to the connection portion of the carriage to move the carriage in the first direction, and the liquid jetting head and the liquid storage tank are arranged to sandwich the connection portion of the carriage therebetween.

11 Claims, 7 Drawing Sheets

LIQUID JETTING APPARATUS

CROSS REFERENCE TO RELATED APPLICATION

The present application claims priority from Japanese Patent Application No. 2011-041621, filed on Feb. 28, 2011, the disclosure of which is incorporated herein by reference in its entirety.

BACKGROUND OF THE INVENTION

1. Field of the Invention

The present invention relates to a liquid jetting apparatus which jets liquid.

2. Description of the Related Art

As a liquid jetting apparatus which jets liquid, Japanese Patent Application Laid-open No. 2010-155417 describes a so-called serial type ink-jet printer. In the serial type ink-jet printer, an ink-jet head is carried on a carriage which moves in a scanning direction along guide rails (guide members) and printing is performed on a recording medium by jetting ink from the ink jet head which moves in the scanning direction together with the carriage.

In the ink jet printer as described in Japanese Patent Application Laid-open No. 2010-155417, four color inks supplied from four ink cartridges disposed outside the carriage are supplied to the ink jet head carried on the carriage, via tubes and a buffer tank carried on the carriage. The ink-jet head is disposed at one end portion in a direction perpendicular to the scanning direction of the carriage. Four storage sections (liquid storage tanks) storing the four color inks respectively are provided in the buffer tank at a portion positioned almost immediately above the ink jet head so that the four storage sections are aligned in a row in the upward and downward directions which is perpendicular to the scanning direction and the direction perpendicular to the scanning direction. Further, a wall of the upper or lower side of each of the four storage sections is formed of a film. In the buffer tank, it is also possible to suppress any pressure fluctuation of the ink contained in each storage section by deforming the film.

Further, in the ink-jet printer as described in Japanese Patent Application Laid-open No. 2010-155417, a driving belt extending in the scanning direction is installed to a front end portion of the carriage. The carriage is pulled by the driving belt to move in the scanning direction.

Here, in the ink-jet printer as described in Japanese Patent Application Laid-open No. 2010-155417, the front end portion of the carriage to which the driving belt is installed is pulled by the driving mechanism to move the carriage in the scanning direction. On the other hand, the ink-jet head which is heavy in weight and the storage sections which are heavy in weight at the time of storing the inks are arranged in the carriage at the other end portion disposed on the side opposite, in the direction perpendicular to the scanning direction, to the one end portion to which the driving belt is installed. Therefore, the center of gravity of the carriage is positioned at a position separated from the one end portion to which the driving belt is installed. Accordingly, the moment, which is applied to the carriage by force generated when the driving belt pulls the carriage to move the carriage in the scanning direction, is increased.

In the ink-jet printer as described in Japanese Patent Application Laid-open No 2010-155417, any backlash is commonly provided between the carriage and the guide rails so that the carriage can move smoothly. Thus, when the moment applied to the carriage is increased, the carriage wobbles (oscillates) during the movement. As a result, there is fear that a position of landing (landing position) of the ink is deviated, thereby deteriorating printing quality.

In recent years, in the ink-jet printer as described in Japanese Patent Application Laid-open No. 2010-155417 etc., there is a tendency of increasing the number of nozzles for the purpose of, for example, speed-up of the printing and/or improvement of the printing quality. If the number of the nozzles is increased, the ink-jet head becomes large in proportion to the number of the nozzles, Corresponding to this, the storage sections also become large in order to supply the inks to the ink-jet head sufficiently. As a result, the center of gravity of the carriage is positioned at a position farther separated from the one end portion to which the driving belt is installed, and thereby further increasing the wobbling (oscillating) of the carriage as described above.

An object of the present teaching is to provide a liquid jetting apparatus which is capable of suppressing wobbling (oscillating) of the carriage during movement.

SUMMARY OF THE INVENTION

According to a first aspect of the present teaching, there is provided a liquid jetting apparatus which jets liquid onto a medium, including: a head unit which includes a liquid jetting head which jets the liquid and a liquid storage tank in which the liquid to be supplied to the liquid jetting head is stored; a guide member which extends in a first direction along a transport surface on which the medium is transported; a carriage which has a connection portion, carries the head unit, and is supported by the guide member to be movable in the first direction; and a movement mechanism which is connected to the connection portion of the carriage to move the carriage in the first direction, wherein the liquid jetting head and the liquid storage tank are arranged to sandwich the connection portion of the carriage therebetween in relation to a second direction perpendicular to the first direction and along the transport surface.

According to the first aspect of the present teaching, the liquid jetting head and the liquid storage tank are arranged to sandwich the connection portion of the carriage which is connected to the movement mechanism therebetween in the second direction. Thus, the center of gravity of the carriage is placed at a position closer to the connection portion of the carriage in the second direction. Accordingly, the moment, which is applied to the carriage by force generated when the movement mechanism pulls the carriage, is decreased and thereby making it possible to suppress wobbling (oscillating) of the carriage during movement.

According to a second aspect of the present teaching, there is provided a liquid jetting apparatus which jets liquid onto a medium, including: a head unit which includes a liquid jetting head which jets the liquid and an electronic component which controls the liquid jetting head; a guide member which extends in a first direction along a transport surface on which the medium is transported; a carriage which has a connection portion, carries the head unit, and is supported by the guide member to be movable in the first direction; and a movement mechanism which is connected to the connection portion of the carriage to move the carriage in the first direction, wherein the liquid jetting head and the liquid storage tank are arranged to sandwich the connection portion of the carriage therebetween in relation to a second direction perpendicular to the first direction and along the transport surface.

According to the second aspect of the present teaching, the liquid jetting head and the electronic component are arranged to sandwich the connection portion of the carriage which is connected to the movement mechanism therebetween in the second direction. Thus, the center of gravity of the carriage is placed at a position closer to the connection portion of the carriage in the second direction. Accordingly, the moment, which is applied to the carriage by force generated when the movement mechanism pulls the carriage, is decreased and thereby making it possible to suppress wobbling (oscillating) of the carriage during movement.

BRIEF DESCRIPTION OF THE DRAWINGS

FIGS. 3A and 3B are plan views each showing the sub-tank unit as viewed from above and indicating a route through which a black ink is allowed to flow, wherein FIG. 3A shows a position of an ink channel on an upper surface of the sub-tank unit and FIG. 3B shows a position of the ink channel on a lower surface of the sub-tank unit.

FIGS. 4A and 4B are plan views each showing the sub-tank unit as viewed from above and indicating a route through which a yellow ink is allowed to flow, wherein FIG. 4A shows a position of an ink channel on the upper surface of the sub-tank unit and FIG. 4B shows a position of the ink channel on the lower surface of the sub-tank unit.

FIGS. 5A and 5B are plan views each showing the sub-tank unit as viewed from above and indicating a route through which a cyan ink is allowed to flow, wherein FIG. 5A shows a position of an ink channel on the upper surface of the sub-tank unit and FIG. 5B shows a position of the ink channel on the lower surface of the sub-tank unit.

FIGS. 6A and 6B are plan views each showing the sub-tank unit as viewed from above and indicating a route through which a magenta ink is allowed to flow, wherein FIG. 6A shows a position of an ink channel on the upper surface of the sub-tank unit and FIG. 6B shows a position of the ink channel on the lower surface of the sub-tank unit.

DESCRIPTION OF THE PREFERRED EMBODIMENTS

Hereinbelow, an explanation will be made about a preferred embodiment of the present teaching. In the following description, for example as shown in FIGS. 1 and 2, left and right directions, front and rear directions, and upward and downward directions are defined to explain the embodiment.

Figure 1:
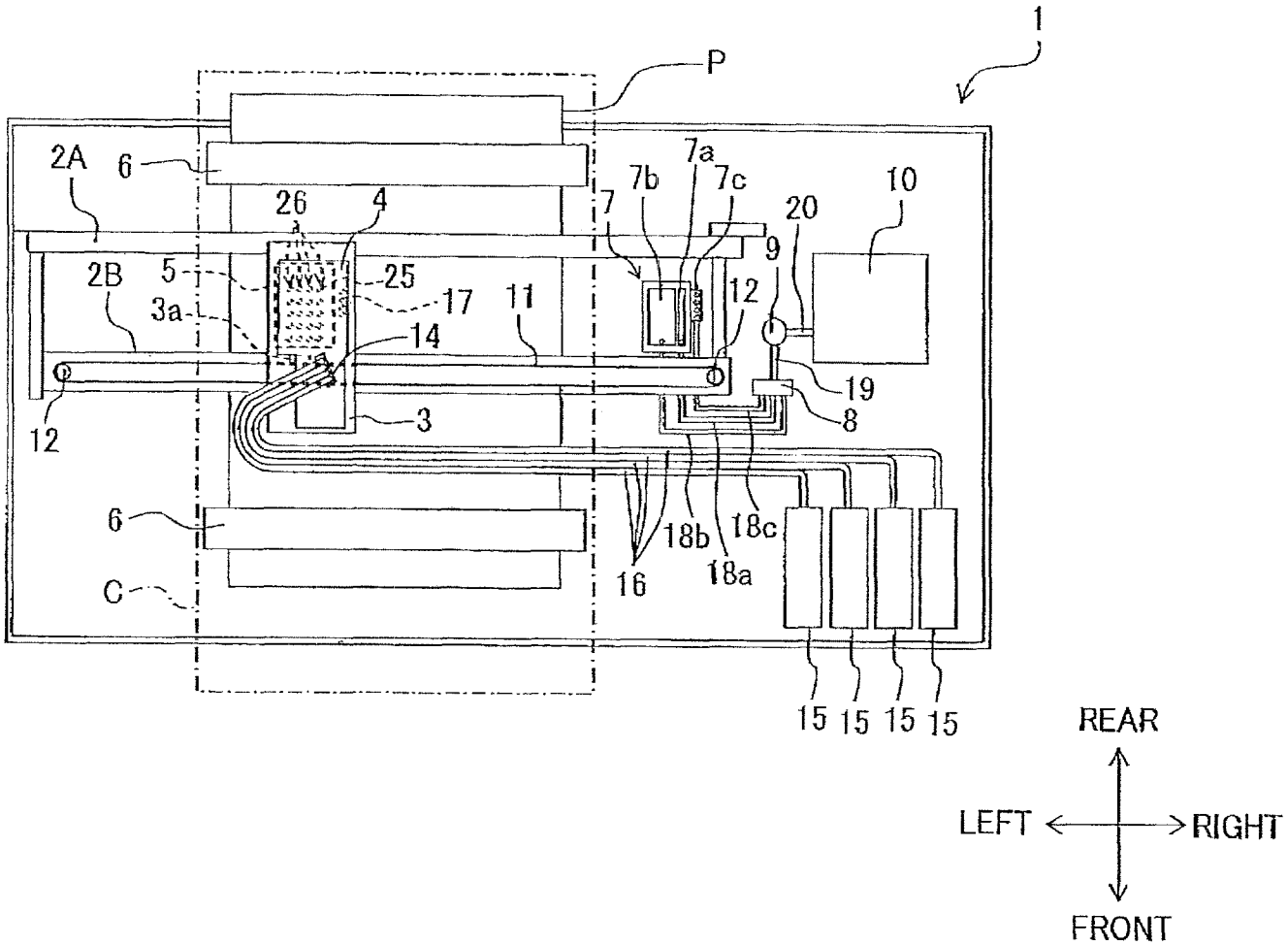
FIG. 1 is a schematic configuration diagram of a printer in accordance with an embodiment of the present teaching.
Figure 2:
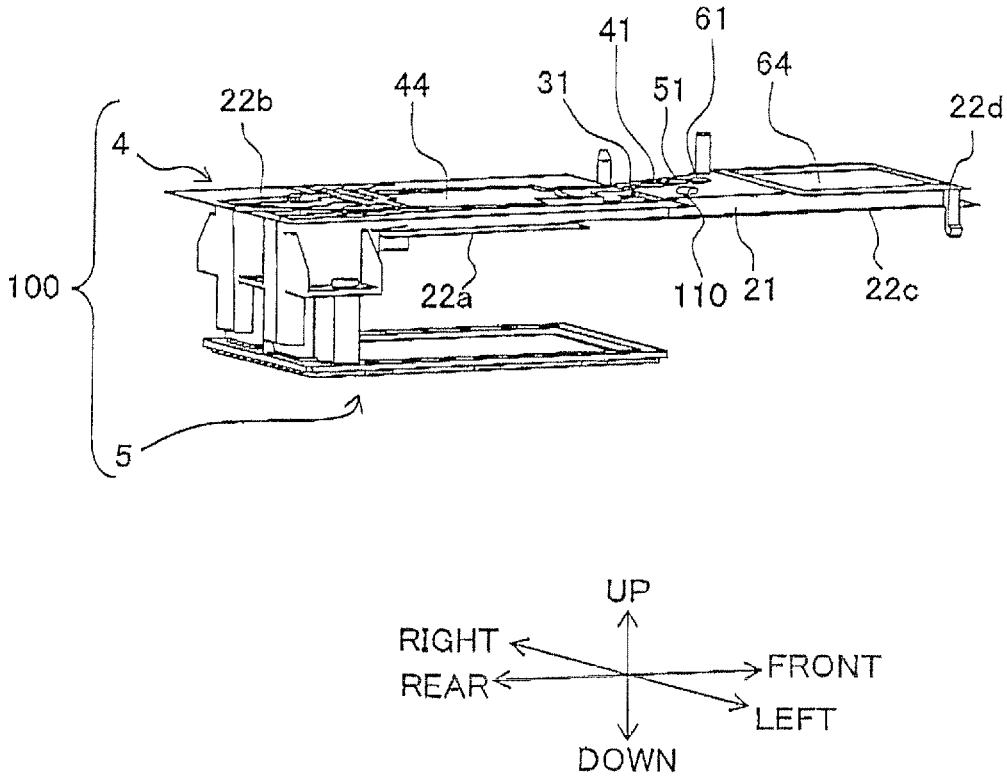
FIG. 2 is a perspective view of a sub-tank unit and an ink-jet head of FIG. 1.

As shown in FIG. 1, a printer 1 according to the embodiment is provided with two guide rails 2A, 2B, a carriage 3, a sub-tank unit 4, an ink-jet head 5, a paper transport roller 6, a cap unit 7, a switching device 8, a suction pump 9, a waste liquid tank 10, etc.

The two guide rails 2A, 2B (guide members) extend in the left and right directions (first direction). The carriage 3 is supported by the guide rails 2A, 2B to be capable of moving in the left and right directions. Further, a belt attachment section 3*a* (connection portion) is provided in the carriage 3 at a substantial center portion in relation to the front and rear directions (second direction). A driving belt 11 is attached to the belt attachment section 3*a*. It is noted that when the ink-jet head 5 is carried on the lower portion of the carriage 3, the belt attachment section 3*a* is desirably provided at a position closer to the ink-jet head 5 (that is, below the central portion in the upward and downward directions of the carriage 3).

The driving belt 11 is an endless belt suspended between two pulleys 12 disposed on both end portions of the guide rail 2B in the left and right directions. The driving belt 11 is suspended between the two pulleys 12 to extend in the left and right direction. When the driving belt 11 is rotated by rotating the pulleys 12 in the both directions by using an unillustrated motor etc., the belt attachment section 3*a* of the carriage 3 is pulled by the driving belt 11 to reciprocatively move the carriage 3 in the left and right directions. The driving belt 11, the pulleys 12, and the motor for driving the pulleys 12 are an example of a movement mechanism of the present teaching.

The sub-tank unit 4 is carried on the carriage 3. A tube joint 14 is provided on the upper surface of the sub-tank unit 4. The sub-tank unit 4 and ink cartridges 15 (liquid supply sources) are connected to each other by connecting four tubes 16, which are connected to the four ink cartridges 15 provided outside the carriage 3, to the tube joint 14. Further, an electronic component 110 for controlling the ink-jet head 5, such as a capacitor, is also provided on the upper surface of the sub-tank unit 4. The electronic component 110 is disposed on the rear side of the belt attachment section 3*a* of the carriage 3 (on the side closer to the ink-jet head 5).

The four ink cartridges 15 store inks of black, yellow, cyan, and magenta, respectively, in the order of the ink cartridges 15 from the left side of FIG. 1. The four color inks stored in the ink cartridges 15 are supplied to the sub-tank unit 4 via the tubes 16. Of the four color inks, the black ink is a pigment ink and three color inks (yellow, cyan, magenta) are dye inks.

The sub-tank unit 4 is provided with air discharge valves 17 (an example of a channel), as will be described later on, to discharge bubbles mixed in the inks supplied from the ink cartridges 15.

The ink-jet head 5 is installed to the rear end portion of the sub-tank unit 4 to form a head unit 100. Further, since the ink-jet head 5 is installed to the rear end portion of the sub-tank unit 4, the ink-jet head 5 is carried on the carriage 3 at the portion positioned at the rear side of the belt attachment section 3*a*. The four color inks are supplied to the ink-jet head 5 from the sub-tank unit 4, and then are jetted from a plurality of nozzles 25 formed on the lower surface of the ink jet head 5. More specifically, the plurality of nozzles 25 are arranged to extend in the front and rear directions and to form four nozzle arrays 26 aligned in the left and right directions. From the plurality of nozzles 25 constructing the respective nozzle arrays 26, the inks of black, yellow, cyan, and magenta are jetted in the order of the nozzle arrays 26 from the right side of FIG. 1.

The paper transport roller 6 transports a recording paper sheet P (recoding medium) in the frontward directions. In this situation, the recording paper sheet P is transported along a horizontal transport surface C which is parallel to the left and right directions and the front and rear directions. In other words, the left and right directions in which the carriage 3 moves are directions along the transport surface C of the recording paper sheet P. Further, the front and rear directions are directions perpendicular to (intersecting) the moving direction of the carriage and along the transport surface C of the recording paper sheet P.

In the printer 1, printing on the recording paper sheet P is performed by jetting the ink from the ink jet head 5, which reciprocates in the left and right directions together with the carriage 3, onto the recording paper sheet P which is transported in the frontward direction by the paper transport roller 6.

The cap unit 7 is disposed at the position which is located below the carriage 3 and is opposed to the carriage 3 in a state that the carriage 3 is moved to the most rightward position.

The cap unit 7 is capable of moving upwardly and downwardly in the upward and downward directions. Further, the cap unit 7 is provided with two nozzle caps 7*a*, 7*b* and an air discharge cap 7*c*.

The nozzle cap 7*a* is opposed to the nozzles 25 from which the black ink is jetted and which construct the nozzle array 26 disposed on the rightmost side in FIG. 1 in a state that the carriage 3 is opposed to the cap unit 7. The nozzle cap 7*b* is opposed to the nozzles 25 from which three color inks (inks of yellow, cyan, and magenta) are jetted and which construct the remaining three nozzle arrays 26 in FIG. 1 in the state that the carriage 3 is opposed to the cap unit 7. The air discharge cap 7*c* is opposed to the air discharge valves 17 in the state that the carriage 3 is opposed to the cap unit 7.

When the cap unit 7 is moved upwardly in the state that the carriage 3 is facing the cap unit 7, the nozzles 25 from which the black ink is jetted and the nozzles 25 from which the three color inks are jetted are covered with the nozzle caps 7*a*, 7*b*, respectively, and the air discharge cap 7*c* is connected to the air discharge valves 17. When the air discharge cap 7*c* is connected to the air discharge valves 17, the air discharge valves 17 are opened to allow the air in the sub-tank unit 4 to be discharged.

The switching device 8 is connected to the nozzle cap 7*a*, the nozzle cap 7*b*, and the air discharge cap 7*c* via tubes 18*a*, 18*b*, 18*c*. Further, the switching device 8 is connected to the suction pump 9 via a tube 19. The switching device 8 selectively connects the suction pump 9 to one of the nozzle cap 7*a*, the nozzle cap 7*b*, and the air discharge cap 7*c*. The suction pump 9 is connected to the waste liquid tank 10 via a tube 20.

In the printer 1, it is possible to selectively perform a black ink purge operation in which the black ink in the ink-jet head 5 is discharged from the nozzles 25, a color ink purge operation in which the three color inks in the ink jet head 5 are discharged from the nozzles 25, and an air discharge purge operation in which the air in the sub-tank unit 4 is discharged from the air discharge valves 17, by driving the suction pump 9 to which any one of the nozzle cap 7*a*, the nozzle cap 7*b*, and the air discharge cap 7*c* is connected in the state that the nozzles 25 are covered with the nozzle caps 7*a*, 7*b* and that the air discharge valves 17 are connected to the air discharge cap 7*c*. Further, the discharged ink etc. is stored in the waste liquid tank 10.

Next, an explanation will be made about the structure of the sub-tank unit 4 an a positional relationship between the sub-tank unit 4 and the ink-jet head 5 and the driving belt 11, with reference to FIG. 2 to FIG. 6B. In FIG. 3A to FIG. 6B, routes through which the inks of black, yellow, cyan, and magenta are allowed to flow are hatched, respectively. Further, in FIG. 3A, FIG. 4A, FIG. 5A, and FIG. 6A, positions of films 22*b*, 22*d*, as will be described later on, are shown by heavy lines. In FIG. 3B, FIG. 4B, FIG. 5B, and FIG. 6B, positions of films 22*a*, 22*c*, as will be described later on, are shown by heavy lines. Furthermore, in FIG. 3A to FIG. 6B, positions of the ink-jet bead 5, the belt attachment section 3*a*, the driving belt 11, and the tube joint 14 are shown by two-dot lines.

As shown in FIG. 2 to FIG. 6B, the sub-tank unit 4 is provided with a sub-tank unit main body 21 and four films 22*a* to 22*d*. The sub-tank unit Main body 21 (tank main body) is a member in the form of a plate which is made of a synthetic resin material, such as polyimide, and extends in the front and rear directions across the belt attachment section 3*a* as shown in FIGS. 3A and 3B. On the upper and lower surfaces of the sub-tank unit main body 21, grooves which form inner spaces of ink channels of after-described ink storage chambers 34, 44, 54, 64, etc., and through-holes which communicate with the grooves on the upper surface and the grooves on the lower surface, and the like, are formed. The films 22*a* to 22*d* are welded on the upper and lower surfaces of the sub-tank unit main body 21 to cover openings of the grooves formed on the upper and lower surfaces of the sub-tank unit main body 21, as will be described later on.

Next, an explanation will be made about a structure of each ink channel forme in the sub-tank unit 4. Four ink supply sections 31, 41, 51, 61 aligned in the front and rear directions are provided on the upper surface of the sub-tank unit main body 21 at the portion at which the tube joint 14 is disposed. The inks of black, yellow, cyan, au magenta supplied from the ink cartridges 15 via the tubes 16 are supplied to the sub-tank unit 4 from the ink supply sections 31, 41, 51, 61, respectively.

Figure 3B:
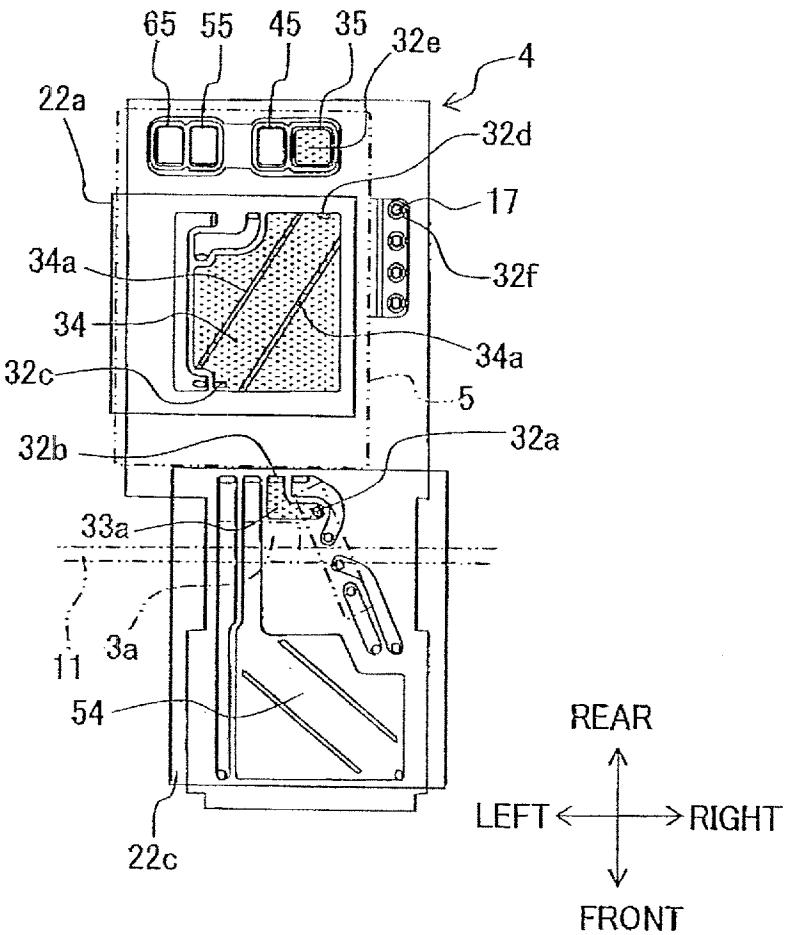
Figure 3A:
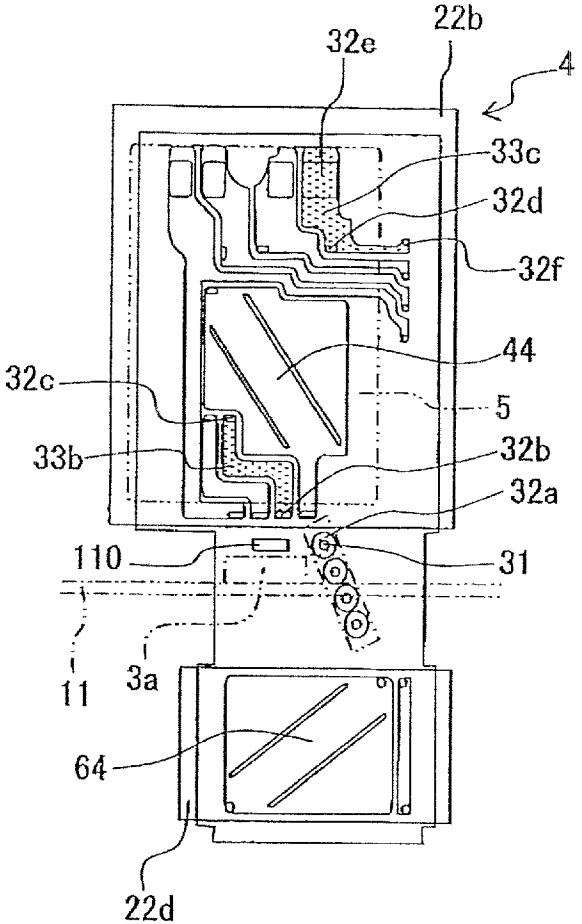

As shown in FIGS. 3A and 3B, the ink supply section 31 to which the black in is supplied is connected to an ink channel 33*a* formed on the lower surface of the sub-tank unit main body 21 via a through-hole 32*a*. The ink-channel 33*a* extends leftward from a connection portion connected to the ink supply section 31 and bends rearward in the middle thereof. Further, the ink channel 33*a* is connected to an ink channel 33*b* formed on the upper surface of the sub-tank unit main body 21 at the end portion disposed on the side opposite to the through-hole 32*a* via a through-hole 32*b*.

The ink-channel 33*b* extends rearward from a connection portion connected to the ink channel 33*a*, bends leftward in the middle while avoiding the ink storage chamber 44 as will be described later on, and further bends rearward. Further, the ink channel 33*b* is connected to the ink storage chamber 34 formed on the lower surface of the sub-tank unit main body 21 at the end portion disposed on the side opposite to the through-hole 32*b* via a through-hole 32*c*.

The ink storage chamber 34 (liquid storage tank) is disposed at a position substantially directly above the ink-jet head 5, and is positioned at the rear side of the belt attachment section 3*a* (disposed at the position closer to the ink jet head 5 than the belt attachment section 3*a* in relation to the second direction). The ink storage chamber 34 has a substantially rectangular flat shape extending in the left and right directions and the front and rear directions. The ink channel 33*b* is connected to the front end portion on the left side of the ink storage chamber 34. The ink storage chamber 34 is connected to an ink channel 33*c* formed on the upper surface of the sub-tank unit main body 21 at the rear end portion on the right side via a through-hole 32*d*. Two ink guide sections 34*a* which are parallel to each other and extend in a direction from the through-hole 32*c* to the through-hole 32*d* are provided in the ink storage chamber 34. The black ink flowed into the ink storage chamber 34 from the through-hole 32*c* is guided toward the through-hole 32*d* by the ink guide sections 34*a*.

The ink channel 33*c* branches off from a connection portion connected to the ink storage chamber 34 to extend rearward and rightward. The ink channel 33*c* is connected to an ink supply channel 35 formed on the lower surface of the sub-tank unit main body 23 at the end portion of the portion, which branches off from said connection portion to extend rearward, via a through-hole 32*e*. The ink supply channel 35 extends downward from a connection portion connected to the ink channel 33*c*, and is connected to the ink-jet head 5 at the lower end portion thereof.

On the other hand, the ink channel 33*c* is connected to one of the air discharge valves 17 provided on the lower surface of the sub-tank unit main body 21 at the end portion of the portion, which branches off from the connection portion connected to the ink storage chamber 34 to extend rightward, via a through-hole 32*f*.

Figure 4B:
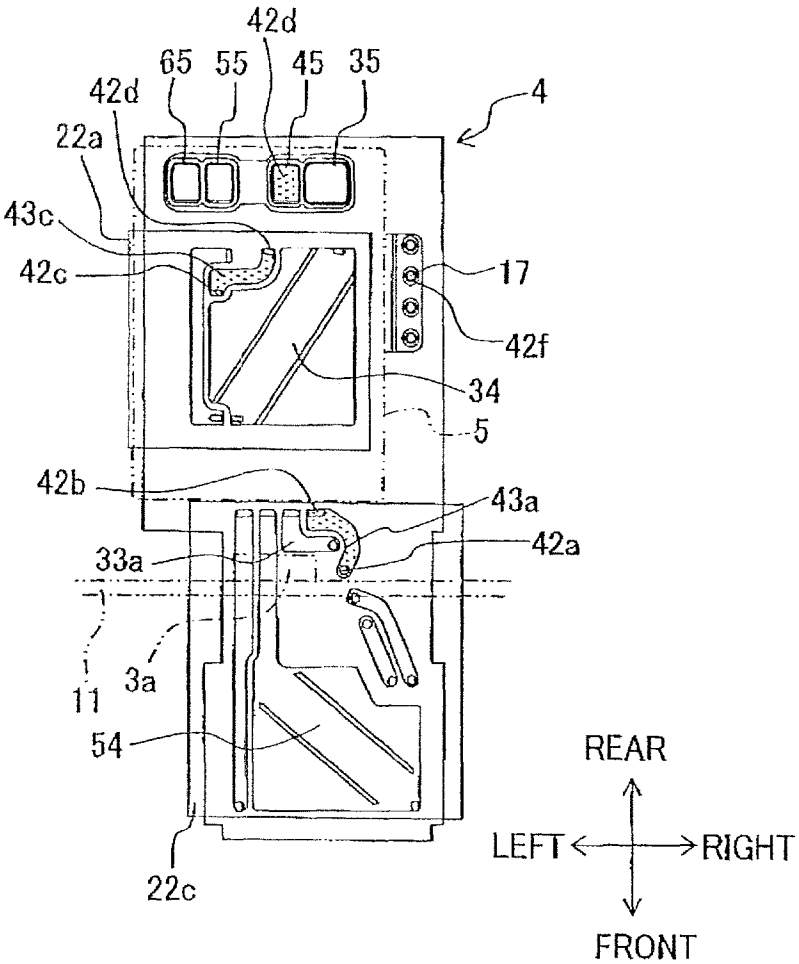
Figure 4A:
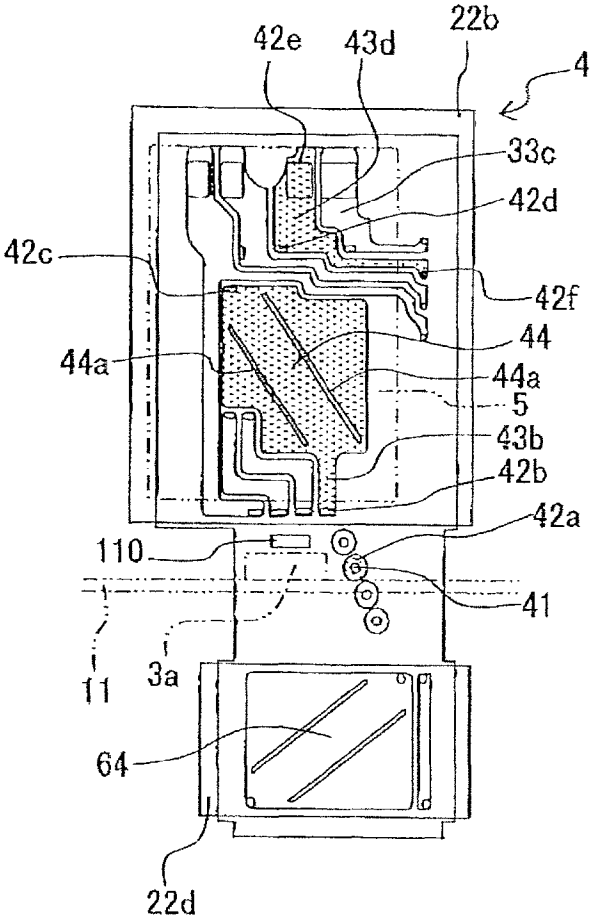

As shown in FIGS. 4A and 4B, the ink supply section 41 to which the yellow ink is supplied is connected to an ink channel 43*a* formed on the lower surface of the sub-tank unit main body 21 via a through-hole 42*a*. The ink-channel 43*a* extends rearward from a connection portion connected to the ink supply section 41 while avoiding the ink channel 33*a*. Further, the ink channel 43*a* is connected to an ink channel 43*b* formed on the upper surface of the sub-tank unit main body 21 at the end portion disposed on the side opposite to the through-hole 42*a* via a through-hole 42*b*.

The ink-channel 43*b* extends rearward from a connection portion connected to the ink channel 43*a*, and is connected to the ink storage chamber 44 (liquid storage tank) formed on the upper surface of the sub-tank unit main body 21 at the end portion disposed on the side opposite to the through-hole 42*a*.

The ink storage chamber 44 is disposed at a position substantially directly above the ink storage chamber 34. The ink storage chambers 34, 44 are arranged in the upward and downward directions (third direction) respectively by being partitioned from each other. By doing so, the ink storage chamber 44 is positioned at the rear side of the belt attachment section 3*a*, like the ink storage chamber 34 (The ink storage chamber 44 is disposed at the position closer to the ink-jet head 5 than the belt attachment section 3*a* in relation to the second direction). The ink storage chamber 44 has the substantially rectangular flat shape extending in the left and right directions and the front and rear directions. The ink channel 43*b* is connected to the front end portion on the right side of the ink storage chamber 44. The ink storage chamber 44 is connected to an ink channel 43*c* formed on the lower surface of the sub-tank unit main body 21 at the rear end portion on the left side via a through-hole 42*c*. Two ink guide sections 44*a* which are parallel to each other and extend in a direction, from a connection portion connected to the ink channel 43*b* to the through-hole 42*c* are provided in the ink storage chamber 44. The yellow ink flowed into the ink storage chamber 44 from the ink channel 43*b* is guided toward the through-hole 42*c* by the ink guide sections 44*a*.

The ink channel 43*c* extends in a right-rear direction from a connection portion connected to the ink storage chamber 44 while having bent portions in the middle. The ink channel 43*c* is connected to an ink channel 43*d* formed on the upper surface of the sub-tank unit main body 21 at the end portion disposed on the side opposite to the through-hole 42*c* via a through-hole 42*d*.

The ink channel 43*d* branches off from a connection portion connected to the ink channel 43*c* to extend rearward and rightward. The portion of the ink channel 43*d* which branches off from the connection portion connected to the ink channel 43*c* to extend rearward is positioned on the left side of the portion of the ink channel 33*c* which branches off from the connection portion connected to the ink storage chamber 34 to extend rearward. The ink channel 43*d* is connected to an ink supply channel 45, which is formed on the lower surface of the sub-tank unit main body 21 to be placed adjacently at the left side of the ink supply channel 35, at the end portion of the portion extending rearward via a through-hole 42*e*. The ink supply channel 45 extends downward from a connection portion connected to the ink channel 43*d*, and is connected to the ink-jet head 5 at the lower end portion thereof.

On the other hand, the portion of the ink channel 43*d* which branches off from the connection portion connected to the ink channel 43*c* to extend rightward is positioned in front of the portion of the ink channel 33*c* which branches off from the connection portion connected to the ink storage chamber 34 to extend rightward. The ink channel 43*d* is connected to one of the air discharge valves 17 provided on the lower surface of the sub-tank unit main body 21 at the end portion of the portion extending rightward via a through-hole 42*f*.

Figure 5B:
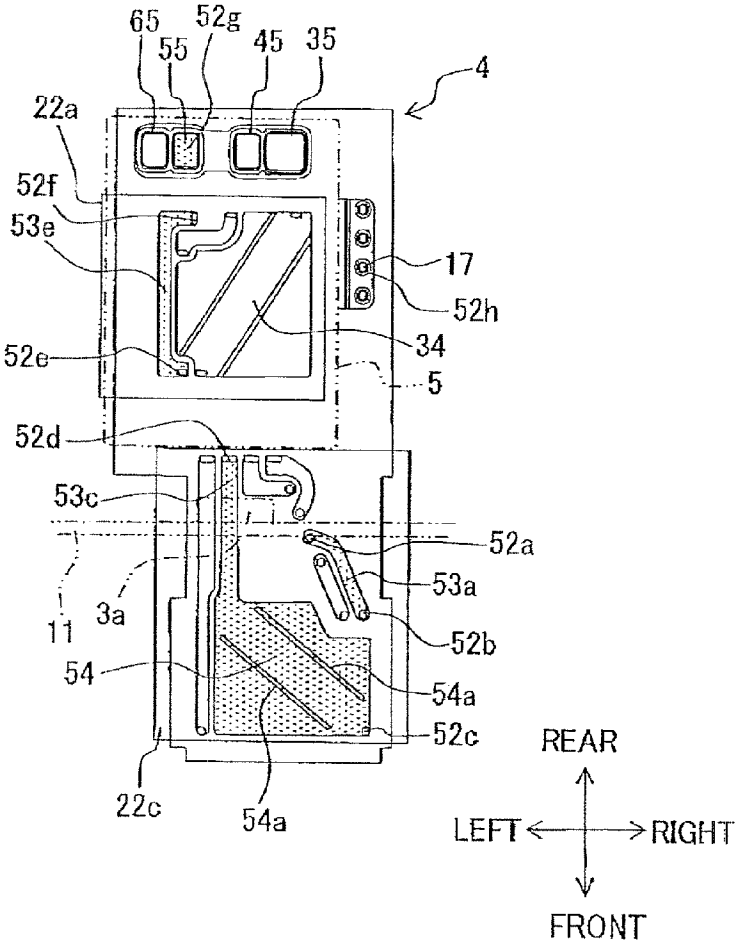
Figure 5A:
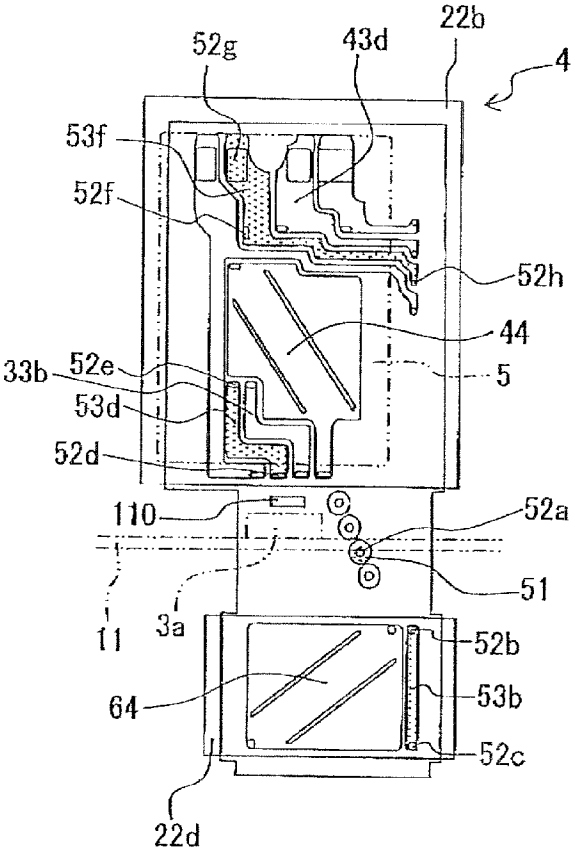

As shown in FIGS. 5A and 5B, the ink supply section 51 to which the cyan ink is supplied is connected to an ink channel 53*a* formed on the lower surface of the sub-tank unit main body 21 via a through-hole 52*a*. The ink-channel 53*a* extends in a right-front direction from a connection portion connected to the ink supply section 51. Further, the ink channel 53*a* is connected to an ink channel 53*b* formed on the upper surface of the sub-tank unit main body 21 at the end portion disposed on the side opposite to the through-hole 52*a* via a through-hole 52*b*.

The ink-channel 53*b* extends frontward from a connection portion connected to the ink channel 53*a*. Further, the ink channel 53*b* is connected to the ink storage chamber 54 (liquid storage tank) formed on the lower surface of the sub-tank unit main body 21 at the end portion disposed on the side opposite to the through-hole 52*a* via a through-hole 52*c*.

The ink storage chamber 54 is positioned in front of the belt attachment section 3*a* (the ink storage chamber 54 is disposed at a position separated in the second direction farther from the ink-jet head 5 than the belt attachment section 3*a*). The ink storage chamber 54 has the substantially rectangular flat shape extending in the left and right directions and the front and rear directions. The ink channel 53*b* is connected to the front end portion on the right side of the ink storage chamber 54. The ink storage chamber 54 is connected to an ink channel 53*c* formed on the lower surface of the sub-tank unit main body 21 at the rear end portion on the left side. Two ink guide sections 54*a* which are parallel to each other and extend in a direction from the through-hole 52*c* to a connection portion connected to the ink-channel 53*c* are provided in the ink storage chamber 54. The cyan ink flowed into the ink storage chamber 54 from the through-hole 52*c* is guided toward the ink-channel 53*c* by the ink guide sections 54*a*.

The ink channel 53*c* extends rearward from a connection portion connected to the ink storage chamber 54. The ink channel 53*c* is connected to an ink channel 53*d* formed on the upper surface of the sub-tank unit main body 21 at the end portion disposed on the side opposite to the ink storage chamber 54 via a through-hole 52*d*.

The ink channel 53*d* extends rearward from the connection portion connected to the ink channel 53*c*, bends leftward in the middle to avoid the ink channel 33*b*, and further bends rearward. Further, the ink channel 53*d* is connected to an ink channel 53*e* formed on the lower surface of the sub-tank unit main body 21 at the end portion disposed on the side opposite to the through-hole 52*d* via a through-hole 52*e*.

The ink channel 53*e* extends rearward from a connection portion connected to the ink channel 53*d* to avoid the ink storage chamber 34 while having a bent portion in the middle. Further, the ink channel 53*e* is connected to an ink channel 53*f* formed on the upper surface of the sub-tank unit main body 21 at the end portion disposed on the side opposite to the through-hole 52*e* via a through-hole 52*f*.

The ink channel 53*f* branches off from a connection portion connected to the ink channel 53*e* to extend rearward and rightward. The portion of the ink channel 53*f* which branches from the connection portion connected to the ink channel 53*e* to extend rearward is positioned on the left side of the portion of the ink channel 43*d* which branches from the connection portion connected to the ink channel 43*c* to extending rearward. The ink channel 53*f* is connected to an ink supply channel 55, which is formed on the lower surface of the sub-tank unit main body 21 to be placed adjacently at the left side of the ink supply channel 45, at the end portion of the portion extending rearward via a through-hole 52*g*. The ink supply channel 55 extends downward from a connection portion connected to the ink channel 53*f*, and is connected to the ink-jet head 5 at the lower end portion thereof.

On the other hand, the portion of the ink channel 53*f* which branches off from the connection portion connected to the ink channel 53*e* to extend rightward is positioned in front of the portion of the ink channel 43*d* which branches off from the connection portion connected to the ink channel 43*c* to extend rightward. The ink channel 53*f* is connected to one of the air discharge valves 17 provided on the lower surface of the sub-tank unit main body 21 at the end portion of the portion extending rightward via a through-hole 52*h*.

Figure 6B:
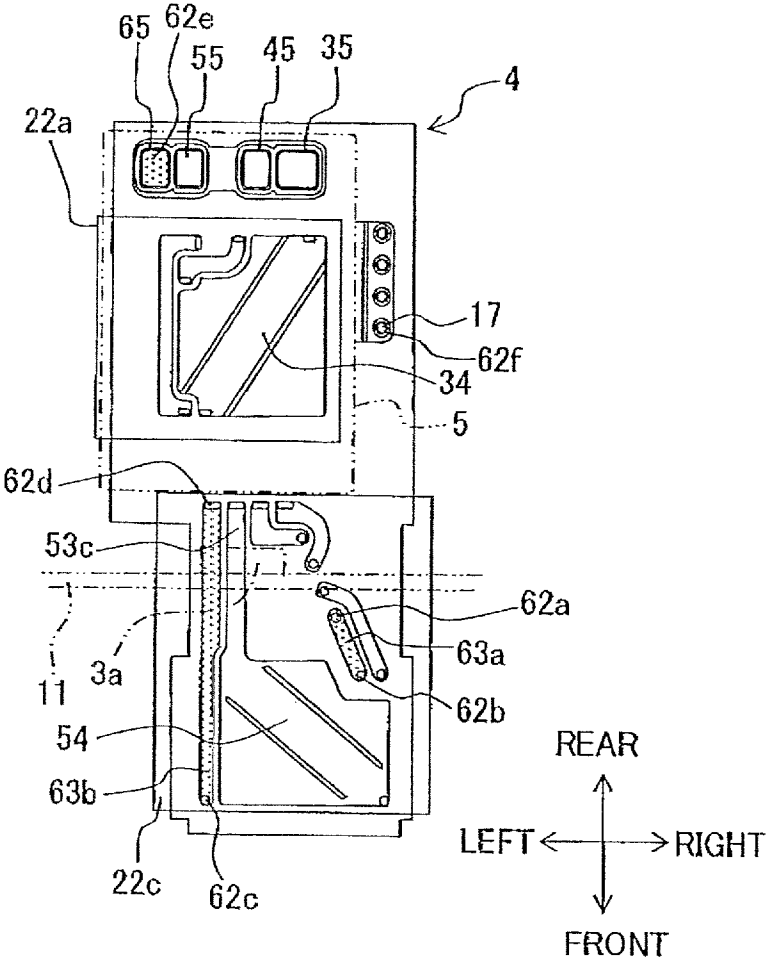
Figure 6A:
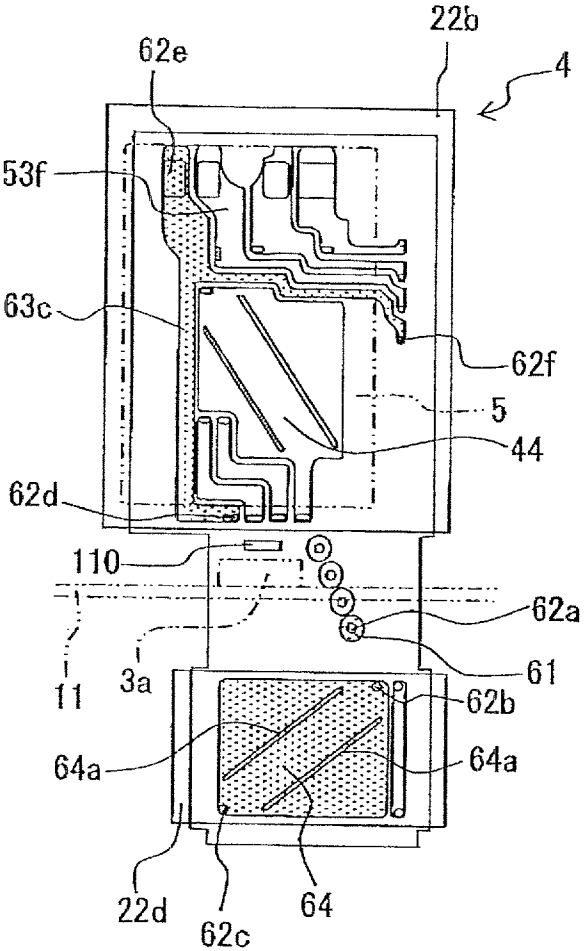

As shown in FIGS. 6A and 6B, the ink supply section 61 to which the magenta ink is supplied is connected to an ink channel 63*a* formed on the lower surface of the sub-tank unit main body 21 via a through-hole 62*a*.

The ink-channel 63*a* extends in a right-front direction from a connection portion connected to the ink supply section 61. Further, the ink channel 63*a* is connected to the ink storage chamber 64 (liquid storage tank) formed on the upper surface of the sub-tank unit main body 21 at the end portion disposed on the side opposite to the through-hole 62*a* via a through-hole 62*b*.

The ink storage chamber 64 is disposed at a position substantially directly above the ink storage chamber 54. The ink storage chambers 54, 64 are arranged in the upward and downward directions respectively by being partitioned from each other. By doing so, the ink storage chamber 64 is positioned in front of the belt attachment section 3*a*, like the ink storage chamber 54 (The ink storage chamber 64 is disposed at the position separated in the second direction farther from the ink-jet head 5 than the belt attachment section 3*a*). The ink storage chamber 64 has the substantially rectangular flat shape extending in the left and right directions and the front and rear directions. The through-hole 62*b* is connected to the rear end portion on the right side of the ink storage chamber 64. The ink storage chamber 64 is connected to an ink channel 63*b* formed on the lower surface of the sub-tank unit main body 21 at the front end portion on the left side via a through-hole 62*c*. Two ink guide sections 64*a* which are parallel to each other and extend in a direction from the through-hole 62*b* to the through-hole 62*c* are provided in the ink storage chamber 64. The magenta ink flowed into the ink storage chamber 64 from the through-hole 62*b* is guided toward the through-hole 62*c* by the ink guide sections 64*a*.

The ink channel 63*b* extends rearward, from a connection portion connected to the ink storage chamber 64, along the left side of the ink storage chamber 54 and the ink channel 53*c*. The ink channel 63*b* is connected to an ink channel 63*c* formed on the upper surface of the sub-tank unit main body 21 at the end portion disposed on the side opposite to the through-hole 62*c* via a through-hole 62*d*.

The ink-channel 63*c* extends leftward from a connection portion connected to the ink channel 63*b* and bends rearward in the middle thereof so as to avoid the ink storage chamber 44. Further, the ink channel 63*c* branches off at the portion, which is positioned at the rear side of the ink storage chamber 44, to extend rearward and rightward.

The portion of the ink channel 63*c* which branches off at said portion to extend rearward is positioned on the left side of the portion of the ink channel 53*f* which branches off from the connection portion connected to the ink channel 53*e* to extend rearward. The ink channel 63*c* is connected to the ink supply channel 65, which is formed on the lower surface of the sub-tank unit main body 21 to be placed adjacently at the left side of the ink supply channel 55, at the end portion of the portion extending rearward via the through-hole 62*e*. The ink supply channel 65 extends downward from a connection portion connected to the ink channel 63*c*, and is connected to the ink-jet head 5 at the lower end portion thereof.

On the other hand, the portion of the ink channel 63*c* which extends rightward is positioned in front of the portion of the ink channel 53*f* which extends rightward. The ink channel 63*c* is connected to one of the air discharge valves 17 provided on the lower surface of the sub-tank unit main body 21 at the end portion of the portion extending rightward via a through-hole 62*f*.

Next, the films 22*a* to 22*d* welded on the sub-tank unit main body 21 will be explained. The film 22*a* is welded on the lower surface of the sub-tank unit main body 21 to cover the openings of the grooves forming the inner spaces of the ink channel 43*c*, the ink channel 53*e* and the ink storage chamber 34 which are formed on the lower surface of the sub-tank unit main body 21.

The film 22*b* is welded on the upper surface of the sub-tank unit main body 21 to cover the openings of the grooves forming the inner spaces of the ink channels 33*b*, 33*c*, 43*b*, 43*d*, 53*d*, 53*f*, 63*c* and the ink storage chamber 44 which are formed on the upper surface of the sub-tank unit main body 21.

The film 22*c* is welded on the lower surface of the sub-tank unit main body 21 to cover the openings of the grooves forming the inner spaces of the ink channels 33*a*, 43*a*, 53*a*, 53*c*, 63*a*, 63*b* and the ink storage chamber 54 which are formed on the lower surface of the sub-tank unit main body 21.

The film 22*d* is welded on the upper surface of the sub-tank unit main body 21 to cover the openings of the grooves forming the inner spaces of the ink channel 53*b* and the ink storage chamber 64 which are formed on the upper surface of the sub-tank unit main body 21.

In the sub-tank unit 4, the films 22*a* to 22*d* are welded on the sub-tank unit main body 21 as described above, thereby covering the openings on the lower side of the ink storage chamber 34 (on the side opposite to the ink storage chamber 44), the openings on the upper side of the ink storage chamber 44 (on the side opposite to the ink storage chamber 34), the openings on the lower side of the ink storage chamber 54 (on the side opposite to the ink storage chamber 64), and the openings on the upper side of the ink storage chamber 64 (on the side opposite to the ink storage chamber 54), with the films 22*a* to 22*d* respectively. The films 22*a* to 22*d* form walls of the ink storage chambers 34, 44, 54, 64, respectively.

Further, in the sub-tank unit 4, the black ink supplied from the ink supply section 31 is supplied to the ink jet head 5 via the ink channel 33*a*, the ink channel 33*b*, the ink storage chamber 34, the ink channel 33*c*, and the ink supply channel 35. The yellow ink supplied from the ink supply section 41 is supplied to the ink-jet head 5 via the ink channel 43*a*, the ink channel 43*b*, the ink storage chamber 44, the ink channel 43*c*, the ink channel 43*d*, and the ink supply channel 45. The cyan ink supplied from the ink supply section 51 is supplied to the ink-jet head 5 via the ink channel 53*a*, the ink channel 53*b*, the ink storage chamber 54, the ink channels 53*c* to 53*f*, and the ink supply channel 55. The magenta ink supplied from the ink supply section 61 is supplied to the ink-jet head 5 via the ink channel 63*a*, the ink storage chamber 64, the ink channel 63*b*, the ink channel 63*c*, and the ink supply channel 65.

Accordingly, the inks having corresponding colors are stored in the ink storage chambers 34, 44, 54, 64, respectively. Therefore, it is possible to prevent the following situation. That is, for example, when each of the inks is jetted from many nozzles 25 concurrently, the ink is not supplied from each of the ink cartridges 15 sufficiently, and thereby causing a so-called under refill phenomenon that causes jetting failure of the ink.

Further, in this situation, the ink in the ink storage chamber 34 (44, 54, 64) having the substantially rectangular flat shape is guided by the ink guide section 34*a* (44*a*, 54*a*, 64*a*) so as to flow in the diagonal line direction of the substantially rectangular flat shape. Therefore, the ink flowed into the ink storage chamber 34 (44, 54, 64) is allowed to flow smoothly without accumulating, for example, in the corner of the ink storage chamber 34 (44, 54, 64). Accordingly, it is possible to prevent the air etc., which is flowed into the sub-tank unit 4 together with the ink, from accumulating, for example, in the corner of the ink storage chamber 34 (44, 54, 64).

Further, in this embodiment, the ink channel 53*b* is arranged adjacently on the right side of the ink storage chamber 64 on the upper surface of the sub-tank unit main body 21 and the ink channel 63*b* is arranged adjacently on the left side of ink storage chamber 54 on the lower surface of the sub-tank unit main body 21. Therefore, this embodiment is different from, for example, the case in which the ink channel is formed on only one side (left or right side) of the ink storage chamber 54 or the case in which the ink channel is formed on only one side (left or right side) of the ink storage chamber 64, in that the area of the ink storage chamber 54 is substantially equal to the area of the ink storage chamber 64 as viewed in a plan view. Thus, it is possible to uniformly suppress any pressure fluctuation of the inks in the ink storage chambers 54, 64.

In this embodiment, the ink channels including both of the ink channels 53*b*, 63*b* are formed. Thus, the ink is allowed to flow from the right-front side to the left-rear side in the ink storage chamber 54 and the ink is allowed to follow from the right-rear side to the left-front side in the ink storage chamber 64. That is, the flowing direction of the ink in the ink storage chamber 54 intersects with the flowing direction of the ink in the ink storage chamber 64 as viewed in a plan view.

Further, in this embodiment, the ink is allowed to flow from the left-front side to the right-rear side in the ink storage chamber 34 and the ink is allowed to flow from the right-front side to the left-rear side in the ink storage chamber 44. That is, the flowing direction of the ink in the ink storage chamber 34 intersects with the flowing direction of the ink in the ink storage chamber 44 as viewed in a plan view. Therefore, the ink storage chambers 34, 44 arranged in the upward and downward directions can be connected to the ink channels disposed on the respective downstream sides at the positions which do not interfere with each other and are separated in the left and right directions from each other.

Further, since the portions of the films 22*a* to 22*d* functioning as the walls of the ink storage chambers 34, 44, 54, 64 are deformed, it is possible to suppress any pressure fluctuation in the inks flowed in the sub-tank unit 4, occurred, for example, when the carriage 3 reciprocatively moves.

Further, the ink supply channels 35, 45, 55, 65 extend in the upward and downward directions respectively. Therefore, even when the air is flowed into the sub-tank unit 4 together with the ink, the air flowed into the sub-tank unit 4 stays at the upper end portion of the ink supply channel 35 (45, 55, 65) and the air is prevented from flowing into the ink-jet head 5 arranged below or under the ink supply channel 35 (45, 55, 65).

Further, the ink channels 33*c*, 43*d*, 53*f*, 63*c* connected to the ink supply channels 35, 45, 55, 65 are connected to the air discharge valves 17. Thus, it is possible to discharge the air stayed in the ink supply channel 35 (45, 55, 65) from the air discharge valve 17 to the outside of the sub-tank unit 4 by performing the air discharge purge operation as described above.

In the above-described printer 1 provided with the carriage 3, the sub-tank unit 4, the ink-jet head 5, etc., the ink jet head 5 and two ink storage chambers 34, 44 of the four ink storage chambers 34, 44, 54, 64 are arranged at the rear side of the belt attachment section 3*a*, and the remaining two ink storage chambers 54, 64 are arranged in front of the belt attachment section 3*a*. That is, the ink-jet head 5 which is relatively heavy in weight and the two ink storage chambers 54, 64 of the four ink storage chambers 34, 44, 54, 64 which are heavy in weight at the time of storing the inks are arranged to sandwich the belt attachment section 3*a* therebetween in relation to the front and rear directions.

Therefore, the center of gravity of the carriage 3 carrying the sub-tank unit 4 and the ink-jet head 5 is positioned closer to the belt attachment section 3*a* placed between the ink storage chambers 54, 64 and the ink-jet head 5 in relation to the front and rear directions. Accordingly, the moment, which is applied to the carriage 3 by force generated when the driving belt 11 pulls the carriage 3, is decreased, and thereby making it possible to suppress wobbling (oscillating) of the carriage 3 during movement in the left and right directions.

Further, compared with the case in which the ink storage chambers 54, 64 are arranged below or under the ink storage chambers 34, 44 as in, the case of Japanese Patent Application Laid-open No. 2010-155417, the ink storage chambers 54, 64 are arranged over or above in the upward and downward directions in this embodiment. Thus, the center of gravity of the carriage 3 is also located on the upper side in the embodiment. Therefore, even when the ink-jet head 5 has a large size to be heavy in weight, it is possible to prevent the center of gravity of the carriage 3 in relation to the upward and downward directions from being separated in the downward direction from the belt attachment section 3*a*.

Further, when the carriage 3 reciprocates in the left and right directions, the carriage 3 is pulled in the left and right direction by the tubes 16 at the portion at which the tube joint 14 is provided. In this embodiment, since the tube joint 14 is provided between the ink storage chambers 54, 64 and the ink-jet head 5 in the front and rear directions, the carriage 3 is pulled by the tubes 16 at the portion which is close to the center of gravity of the carriage 3 in relation to the front and rear directions. Accordingly, the moment, which is applied to the carriage 3 by force generated when the tubes 16 pull the carriage 3, is decreased and thereby making it possible to suppress the wobbling (oscillating) of the carriage 3 during the movement in the left and right directions.

Further, since the tube joint 14 is provided at the position which is close to the center of gravity of the carriage 3 in relation to the front and rear directions, it is possible to prevent the center of gravity of the carriage 3 from deviating frontward or rearward.

Further, it can be also assumed that all of the four ink storage chambers 34, 44, 54, 64 are arranged in front of the belt attachment section 3*a*, unlike this embodiment. In this case, however, it is necessary to have a large space for arranging all of the four ink storage chambers 34, 44, 54, 64 in front of the belt attachment section 3*a*, thereby causing the size of the carriage 3 to become greater.

In view of this, in this embodiment, all of the four ink storage chambers 34, 44 54, 64 are not arranged in front of the belt attachment section 3*a*, but only the two ink storage chambers 54, 64 are arranged in front of the belt attachment section 3*a* and the remaining two ink storage chambers 34, 44 are arranged at the rear side of the belt attachment section 3*a* together with the ink-jet head 5. By doing so, the four ink storage chambers 34, 44, 54, 64 can be arranged by using a space positioned at the rear side of the belt attachment section 3*a* of the carriage 3 effectively, and thus the following situation can be avoided such that the size of the carriage 3 becomes greater by arranging all of the ink storage chambers in front of the belt attachment section 3*a*.

In this embodiment, the grooves forming the inner spaces of the two ink storage chambers 34, 44 are formed in the sub-tank unit main body 21, which extends in the front and rear directions across the belt attachment section 3*a*, at the portions positioned at the rear side of the belt attachment section 3*a* by being partitioned in the upward and downward directions from each other. The grooves forming the inner spaces of the two ink storage chambers 54, 64 are formed in the sub-tank unit main body 21, which extends in the front and rear directions across the belt attachment section 3*a*, at the portions in front of the belt attachment section 3*a* by being partitioned in the upward and downward directions from each other. All of the grooves forming the inner spaces of the ink storage chambers 34, 44, 54, 64 are opened on the upper and lower surfaces of the sub-tank unit main body 21 together with the grooves forming the inner spaces of other ink channels.

Accordingly, it is possible to cover all of the openings of the grooves forming the inner spaces of the ink storage chambers 34, 44, 54, 64 and other ink channels just by welding the films 22*a* to 22*d* to the upper and lower surfaces of the sub-tank unit main body 21. That is, when the films 22*a* to 22*d* are welded to the sub-tank unit main body 21, any other constitutive parts of the sub-tank unit main body 21 do not disturb the welding of the films. Thus, the production of the sub-tank unit 4 becomes easy.

The ink channel, which extends, at first, frontward from the ink supply section 51 (61) toward the ink storage chamber 54 (64) and further extends rearward from the ink storage chamber 54 (64) toward the ink-jet head 5, has a length longer than that of the ink channel which extends rearward directly from the ink supply section 31 (41) via the ink storage chamber 34 (44) to arrive at the ink-jet head 5.

In view of this, the following configuration is adopted in this embodiment. That is, two color inks of the three color inks which are dye inks having the low viscosity are allowed to flow through the longer ink channels including the ink storage chambers 54, 64 disposed in front of the belt attachment section 3*a*, and the black ink which is the pigment ink having the high viscosity and the remaining one color ink are allowed to flow through the shorter ink channels including the ink storage chambers 34, 44 disposed at the rear side of the belt attachment section 3*a*. Accordingly, the pigment ink having the high viscosity supplied to the sub-tank unit 4 can be prevented from increasing in viscosity before the pigment ink is supplied to the ink-jet head 5.

Next, modified embodiments in which various modifications are made in the embodiment will be described below. However, the description of components having the same structure as in the embodiment is appropriately omitted.

In the above embodiment, the tube joint 14 is provided between the ink storage chambers 54, 64 and the ink-jet head 5 in relation to the front and rear directions. However, the present teaching is not limited thereto. For example, the tube joint 14 may be provided at a portion of the carriage 3 which is other than the portion positioned between the ink storage chambers 54, 64 and the ink-jet head 5 in the front and rear directions, such as in front of the ink storage chambers 54, 64.

In the above embodiment, the black ink which is the pigment ink having the high viscosity is allowed to flow through the shorter ink channel including the ink storage chamber 34 disposed at the rear side of the belt attachment section 3*a*. However, the present teaching is not limited thereto. That is, the black ink which is the pigment ink is allowed to flow through the ink channel including any one of the ink storage chambers 54, 64 disposed in front of the belt attachment section 3*a*.

In the above embodiment, the sub-tank unit 4 is formed by welding the films 22*a* to 22*d* to the sub-tank unit main body 21. By doing so, the two ink storage chambers 34, 44 are disposed at the rear side of the belt attachment section 3*a* by being partitioned in the upward and downward directions from each other. Further, the two ink storage chambers 54, 64 are disposed in front of the belt attachment section 3*a* by being partitioned in the upward and downward directions from each other. However, the present teaching is not limited thereto.

Further, the wall on the lower side of the ink storage chamber 34 (54), which is disposed on the lower side among the ink storage chambers 34, 44, 54, 64 arranged by being partitioned in the upward and downward directions from each other as described above, is formed by the film 22*a* (22*c*) welded on the lower surface of the sub-tank unit main body 21. The wall on the lower side of the ink storage chamber 44 (64), which is disposed on the upper side, is formed by the film 22*b* (22*d*) welded on the upper surface of the sub-tank unit main body 21. However, the present teaching is not limited thereto.

For example, the ink storage chambers 33, 44 (the ink storage chambers 54, 64) may be arranged in a direction other than the upward and downward directions, such as the left and right directions. Further, a part of the wall of the ink storage chamber 34 (44, 54, 64) may not be formed by the welded film. For example, the sub-tank unit 4 may be formed entirely of the same synthetic resin material as the sub-tank unit main body 21.

Further, in view of the weight of the ink-jet head 5, the weight of the ink storage chamber 34 (44, 54, 64) in a state of storing the ink, etc., one or three ink storage chamber(s) among the four ink storage chambers 34, 44, 54, 64 may be disposed in front of the belt attachment section 3*a* and the remaining ink storage chamber(s) may be disposed at the rear side of the belt attachment section 3*a*.

Furthermore, the present teaching is not limited to the configuration in which a part of the four ink storage chambers are arranged at the rear side of the belt attachment section 3*a* (on the side close to the ink-jet head 5 in relation to the front and rear directions). All of the four ink storage chambers may be disposed in front of the belt attachment section 3*a*.

In the above embodiment, the ink storage chambers 54, 64 and the ink-jet head 5 are arranged to sandwich the belt attachment section 3*a* therebetween in relation to the front and rear directions. Further, the electronic component 110 and the air discharge valves 17 are disposed at the rear side of the belt attachment section 3*a* (on the side closer to the ink-jet head 5). However, the present teaching is not limited thereto. For example, the following configuration is allowable. That is, when the ink-jet head 3 is positioned at the rear side of the belt attachment section 3*a*, at least one of the ink storage chambers 54 and 64, the electronic component 110, and the air discharge valves 17 is disposed in front of the belt attachment section 3*a* depending on the weight of the ink-jet head, thereby placing the center of gravity of the carriage 3 closer to the belt attachment section 3*a*.

In the above embodiment, the four color inks are jetted from the ink-jet head 5, and the four ink storage chambers are provided in the sub-tank unit 4 corresponding to the four ink colors. However, the present teaching is not limited thereto.

That is, the ink-jet head 5 may jet two color inks, three color inks, or inks of not less than five colors, and the same number of ink storage chambers as the types of the inks to be jetted may be provided in the sub-tank unit 4.

Further, the following configuration is allowable. That is, ink-jet head 5 jets one color ink only, such as the black ink, and one ink storage chamber is provided in the sub-tank unit 4 at the portion in front of the belt attachment section 3*a*. Then, the ink-jet head 5 and said one ink storage chamber are arranged to sandwich the belt attachment section 3*a* therebetween in the front and rear directions.

In the above embodiment, the ink-jet head 5 and the ink storage chambers 54, 64 are arranged to sandwich the belt attachment section 3*a* therebetween in the front and rear directions perpendicular to the left and right directions which is the moving direction of the carriage. However, the present teaching is not limited thereto. The ink jet head 5 and the ink storage chambers 54, 64 may be arranged to sandwich the belt attachment section 3*a* therebetween in a direction which is inclined in relation to the left and right directions and the front and rear directions as viewed in a plan view. That is, the ink-jet head 5 and the ink storage chambers 54, 64 may be arranged to sandwich the belt attachment section 3*a* therebetween in a direction (second direction) which is other than the front and rear directions perpendicular to the moving direction (first direction) of the carriage and along the transport surface C on which the recording paper sheet is transported.

In the above embodiment, the ink cartridges 15 provided outside the carriage 3 and the sub-tank unit 4 are connected by the tubes 16, thereby supplying the inks stored in the ink cartridges 15 to the sub-tank unit 4 via the tubes 16. However, the present teaching is not limited thereto.

Figure 7:
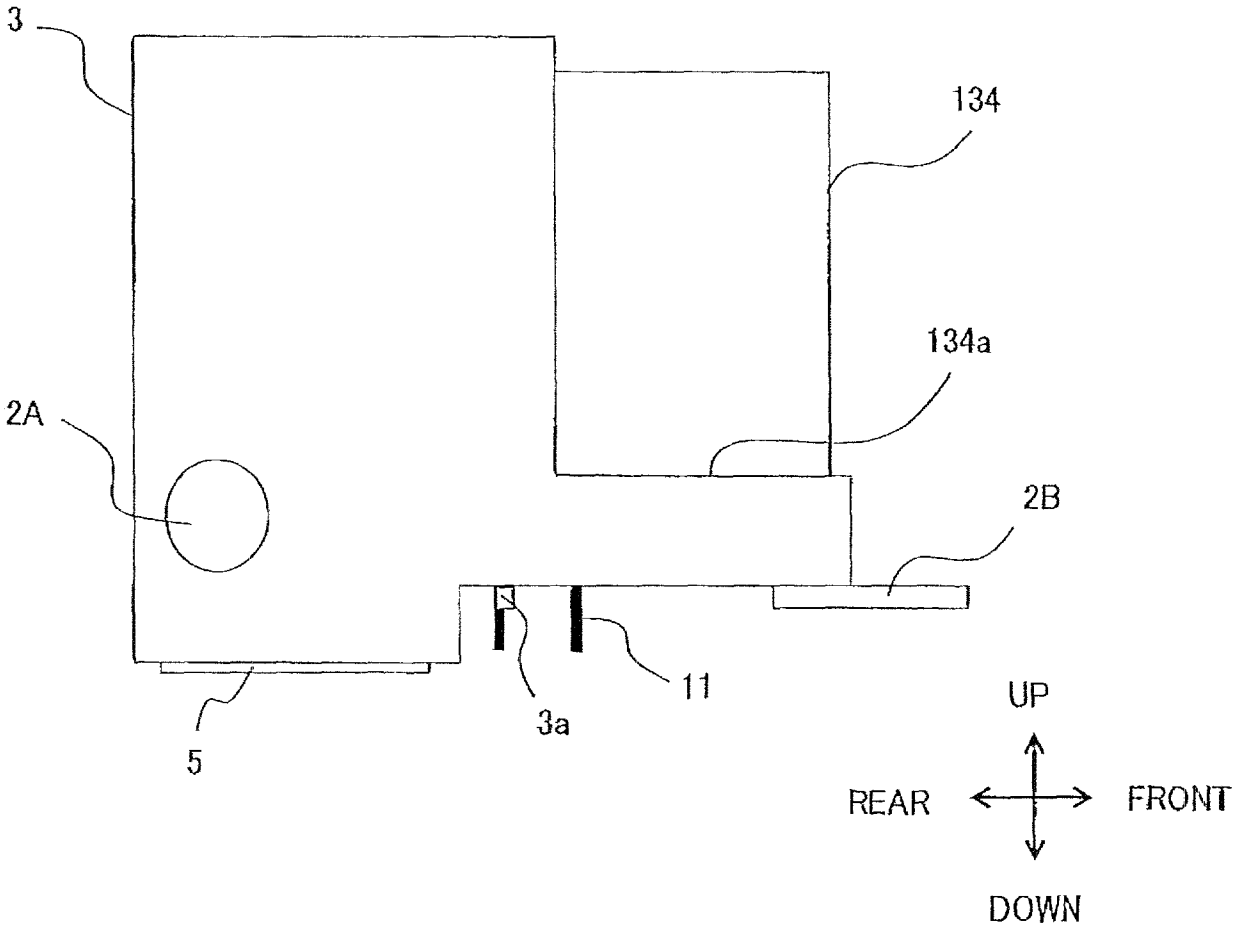
FIG. 7 shows an example in which the present teaching is applied to an on-carriage type printer.

For example, the present teaching is also applicable to a printer provided with an ink-jet head of a so-called station supply system. The station supply system is a system as follows. That is, an ink supply station provided with an ink supply source is provided outside the carriage. When the ink is not jetted from the ink-jet head, the carriage is moved to connect the sub-tank unit to the ink supply station. By doing so, the ink is supplied from the ink supply source to the sub-tank unit and then is stored in the ink storage chamber. Alternatively, the present teaching is also applicable to a printer of what is called an on-carriage type as shown in FIG. 7. In the printer of the on-carriage type, the ink cartridges 134 (an example of a liquid cartridge) are detachably carried on the carriage 3, and the inks of the respective colors are supplied from the ink cartridges 134 carried on the carriage 3 to the ink-jet head 5. In this case, ink cartridge installing sections 134*a* of the carriage 3 and the ink-jet head 5 may be arranged to sandwich the belt attachment section 3*a* of the carriage 3 therebetween in relation to the front and rear directions. Then, the ink cartridges 134 are installed to the ink cartridge installing sections 134*a*, thereby making it possible to placing the center of gravity of the carriage 3 closer to the belt attachment section 3*a*.

In the above embodiment and modified embodiments, the carriage 3 is installed to the driving belt 11. However, the present teaching is not limited thereto. Any other component is allowable provided that the carriage 3 is installable to the component and that the carriage 3 can be reciprocatively moved in the left and right directions by being engaged with the pulleys 12 to drive and rotate the pulleys 12. For example, a wire etc. may be used instead of the driving belt 11.

In the above description, the explanations are made about the examples in which the present teaching is applied to the printer provided with the ink jet head which jets the ink. However, the present teaching is not limited thereto. It is possible to apply the present teaching to a liquid jetting apparatus which is other than the printer and is provided with a liquid jetting head which jets liquid other than the ink.

What is claimed is:

1. A liquid jetting apparatus which jets liquid onto a medium, comprising:

a head unit which includes:

a liquid jetting head which jets the liquid; and a liquid storage tank in which the liquid to be supplied to the liquid jetting head is stored;

a guide member which extends in a first direction along a transport surface on which the medium is transported;

a carriage which has a connection portion, carries the bead unit, and is supported by the guide member to be movable in the first direction; and a movement mechanism which is connected to the connection portion of the carriage to move the carriage in the first direction;

wherein the liquid jetting head and the liquid storage tank are arranged to sandwich the connection portion of the carriage therebetween in relation to a second direction perpendicular to the first direction and along the transport surface.

2. The liquid jetting apparatus according to claim 1; further comprising a liquid supply source which is disposed outside the carriage and supplies the liquid to the liquid storage tank; and wherein the liquid storage tank is a sub tank which temporarily stores the liquid supplied from the liquid supply source before the liquid is supplied to the liquid jetting head.

3. The liquid jetting apparatus according to claim 1;

wherein the liquid storage tank is a liquid cartridge which is detachably carried on the carriage.

4. The liquid jetting apparatus according to claim 1;

wherein the movement mechanism includes a driving belt which extends in the first direction and is connected to the carriage to move the carriage in the first direction; and wherein the liquid storage tank and the liquid jetting head are arranged to sandwich the connection portion therebetween in relation to the second direction.

5. The liquid jetting apparatus according to claim 4, further comprising;

a tube which is configured to supply the liquid and which connects the liquid storage tank to the liquid supply source;

wherein a tube joint to be connected to the tube is further provided on the carriage at a position between the liquid storage tank and the liquid jetting head in relation to the second direction.

6. The liquid jetting apparatus according to claim 4;

wherein the liquid includes a plurality of types of liquids;

wherein the liquid jetting head jets the plurality of types of liquids separately;

wherein the liquid storage tank is formed as a plurality of liquid storage tanks in which the plurality of types of liquids are stored respectively;

wherein a part of the liquid storage tanks are disposed at a position closer to the liquid jetting bead in relation to the second direction than the connection portion; and wherein a remaining part of the liquid storage tanks and the liquid jetting head are arranged to sandwich the connection portion therebetween in relation to the second direction.

7. The liquid jetting apparatus according to claim 6;

wherein the plurality of types of liquids include a pigment ink and a dye ink; and wherein at least a liquid storage tank, of the plurality of liquid storage tanks, which stores the pigment ink is disposed at the position closer to the liquid jetting head in relation to the second direction than the connection portion.

8. The liquid jetting apparatus according to claim 6;

wherein the plurality of types of liquids include four types of liquids;

wherein the liquid storage tank is formed as four liquid storage tanks in which the four types of liquids are stored respectively;

wherein the four liquid storage tanks are formed by a tank main body and films;

wherein the tank main body is a member being in the form of a plate extending in the second direction across the connection portion, having two spaces, which are formed by being partitioned in upward and downward directions and are opened on an upper surface and a lower surface of the member, at a portion positioned closer to the liquid jetting head in relation to the second direction than the connection portion, and having another two spaces, which are formed by being partitioned in upward and downward directions and are opened on an upper surface and a lower surface of the member, at a portion positioned on a side opposite to the liquid jetting head with the connection portion intervening therebetween; and wherein the films are welded on the upper surface and the lower surface of the tank main body respectively to cover openings of the upper surface and the lower surface of the tank main body.

9. The liquid jetting apparatus according to claim 8;

wherein the upward direction is orthogonal to both of the first and second direction and the downward direction is orthogonal to both of the first and second direction.

10. A liquid jetting apparatus which jets liquid onto a medium, comprising:

a head unit which includes:

a liquid jetting head which jets the liquid; and an electronic component which controls the liquid jetting head;

a guide member which extends in a first direction along a transport surface on which the medium is transported;

a carriage which has a connection portion, carries the head unit, and is supported by the guide member to be movable in the first direction; and a movement mechanism which is connected to the connection portion of the carriage to move the carriage in the first direction;

wherein the liquid jetting head and the electronic component are arranged to sandwich the connection portion of the carriage therebetween in relation to a second direction perpendicular to the first direction and along the transport surface.

11. The liquid jetting apparatus according to claim 10;

wherein the movement mechanism includes a driving belt which extends in the first direction and is connected to the carriage to move the carriage in the first direction; and the electronic component and the liquid jetting head are arranged to sandwich the connection portion therebetween in relation to the second direction.

* * * * *